US010442516B2

(12) United States Patent
Small

(10) Patent No.: US 10,442,516 B2
(45) Date of Patent: Oct. 15, 2019

(54) MARINE PROPULSION SYSTEM

(71) Applicant: Mark Small, Pompano Beach, FL (US)

(72) Inventor: Mark Small, Pompano Beach, FL (US)

( * ) Notice: Subject to any disclaimer, the term of this patent is extended or adjusted under 35 U.S.C. 154(b) by 0 days.

(21) Appl. No.: 16/037,607

(22) Filed: Jul. 17, 2018

(65) Prior Publication Data

US 2019/0061899 A1 Feb. 28, 2019

Related U.S. Application Data

(60) Provisional application No. 62/533,340, filed on Jul. 17, 2017.

(51) Int. Cl.
*B63H 23/06* (2006.01)
*B63H 5/125* (2006.01)

(52) U.S. Cl.
CPC ..... *B63H 23/06* (2013.01); *B63H 5/125* (2013.01); *B63H 5/1252* (2013.01); *B63H 2005/1256* (2013.01)

(58) Field of Classification Search
CPC ..... B63H 23/06; B63H 5/125; B63H 5/1252; B63H 2005/1256
See application file for complete search history.

(56) References Cited

U.S. PATENT DOCUMENTS 3,654,889 A * 4/1972 Bergstedt ..... B63H 20/002 440/57
3,708,251 A * 1/1973 Pierro ..... B63H 5/125 310/263
RE34,011 E 7/1992 Brandt
5,445,545 A * 8/1995 Draper ..... B63H 20/007 440/6
5,494,466 A * 2/1996 Vernea ..... B63H 5/10 192/51
5,947,779 A * 9/1999 Heideman ..... B63H 5/10 440/6
6,045,420 A 4/2000 Small et al.
6,193,573 B1 2/2001 Small
6,213,824 B1 4/2001 Small
6,325,010 B1 12/2001 Gruenwald
6,390,776 B1 5/2002 Gruenwald
6,461,206 B2 10/2002 Small et al.
6,783,410 B2 8/2004 Florander et al.
6,971,932 B2 12/2005 Maselter
7,104,853 B1 9/2006 Kepka
7,226,327 B2 6/2007 Hallenstvedt et al.
7,588,473 B2 9/2009 Beachy Head
8,430,701 B2 4/2013 Jegel et al.
9,630,692 B2 4/2017 Hasl et al.

* cited by examiner

*Primary Examiner* — Stephen P Avila
(74) *Attorney, Agent, or Firm* — McHale & Slavin, P.A.

(57) ABSTRACT

A marine propulsion system having a steering axis that allows pivoting of propellers along a first vertical axis directly beneath a gear box located inside the hull of a boat. A lower gear box can be placed within a vented or non-vented tunnel eliminating the need for a rudder and providing directional control of the boat by the orientation of the lower gear box. Surface piercing propellers and/or counter-rotating propellers may be used with the propellers pivoted around the vertical axis of the gear box. The offset steering axis allows pivoting around the first vertical axis wherein a secondary axis is moved with minimal drag providing superior maneuverability at both high and low speeds.

7 Claims, 12 Drawing Sheets

100

16
31
A
A

MARINE PROPULSION SYSTEM

PRIORITY CLAIM

In accordance with 37 C.F.R. § 1.76, a claim of priority is included in an Application Data Sheet filed concurrently herewith. Accordingly, the present invention claims priority to U.S. Provisional Patent Application No. 62/533,340 entitled "Marine Propulsion System", filed on Jul. 17, 2017, the contents of which is incorporated herein by reference in its entirety.

FIELD OF THE INVENTION

The invention is in the marine industry and, in particular, to an improved propulsion system for use with boats.

BACKGROUND OF THE INVENTION

The marine propulsion industry has changed through recent years. On small boats, the use of outboard motors are the most popular but have certain limitations, namely the stern of the boat is consumed by the outboard motor. This position has multiple drawbacks for fisherman including accessing the transom of the boat for swimming or fishing. Boats with an outboard have limited space for use of a swim platform. If the boat has two, three, or four outboards, the transom of the boat is essentially non accessible. Stern drive propulsion units have also been popular but, similar to an outboard, the position of the propeller at the back of the boat makes them less desirable for fisherman, swimmers and divers. Also, the positioning of the propeller at the back of the boat has certain steering limitations as the thrust from the propeller is used to move the boat.

Inboard positioned propulsion systems found on larger recreational boats, including diesel engine driven vessels, have seen competition from "Pods". Pods are a relatively new development, initially brought to the recreational yachting market by Volvo, and followed by Mercury and Twin Disc. They are large drive propulsion units that are installed under the bottom of the boat which steer the propellers and drives for better handling than inboards with rudders. Further, Pods typically include counter-rotating propellers with improved efficiency. The installation of Pods requires substantial changes to the boat bottom and general layout of other features within the boat.

One other significant improvement in boat performance is the use of surface piercing propellers. Counter-rotating propellers have also been used to achieve the benefit of both the surfacing propeller technology and counter rotation together for maximum performance. Surface piercing propellers are generally found on drives with propellers in back of the transom because they require a huge amount of ambient air for the upper part of the propeller.

The Applicant holds a number of patents for a technology marketed as Power Vent®, including U.S. Pat. Nos. 6,045,420; 6,193,573; 6,213,824; 6,325,010; 6,390,776; and U.S. Pat. No. 6,461,206. This technology positions a surface piercing propeller beneath the hull of an inboard powered boat with the propeller vented to atmosphere through a vent to the transom. This technology has been proven in boats with over 2,000 horsepower at speeds of over 50 knots. However, low speed handling with rudders is not as good as a Pod drive, and larger boats with a single drive stem require a bow thruster docking.

It is also problematic to put counter-rotating steering drives under boat hulls because they require a large space under the boat. The drives also require significant vertical space and result in a deep water draft limiting where these boats can go. Outboards can tilt upward for swallow water use. Stern Drives can also tilt but to a much less degree than the outboards. Surfacing drives require only one-half of the propeller to be in the water, further improving shallow water capability.

What is lacking in the industry is a propulsion system having a steering function that allows placement in confined areas, such as a vented or non-vented boat hull tunnel.

SUMMARY OF THE INVENTION

The current invention discloses the use of an under hull drive system that requires minimal draft. This design allows the use of surfacing propellers where air entry for a propeller is possible by the use of an air duct. The design places the propellers under the hull of the boat thereby freeing up the transom of the boat for use with swim platforms, fishing, or the like matter that benefits from no propellers extending beyond the hull of the boat.

An objective of the instant invention is to employ a propulsion system having a steering axis that is offset from a main power input shaft, wherein the offset is such that the swivel action for the steering is on a vertical axis through the center of twin counter-rotating propellers.

Another objective of the instant invention is to teach the use of a transfer case that allows a coupling from a rotational source to a gear case to provide a steering axis offset.

Another objective of the instant invention is to teach the use of a steering axis capable of handling high pressure loading from high speed maneuvering with minimal effort.

Still another objective of the instant invention is to provide a propulsion system that provides steerable propellers in a vented or non-vented tunnel.

Yet still another objective of the instant invention is to teach the use of a small through-hull hole, as compared to the large through-hull required by a pod propulsion system, allowing for easier installations without requiring reinforcement of the boat hull to compensate for a large through-hull.

Yet still another objective of the instant invention is to teach the use of a steerable marine drive system that fits within a tunnel to reduce or eliminate the draft of a propulsion system beneath a boat hull.

Other objectives and further advantages and benefits associated with this invention will be apparent to those skilled in the art from the description, examples and claims which follow.

DRAWING DESCRIPTION

DESCRIPTION OF THE INVENTION

Detailed embodiments of the instant invention are disclosed herein; however, it is to be understood that the disclosed embodiments are merely exemplary of the invention, which may be embodied in various forms. Therefore, specific functional and structural details disclosed herein are not to be interpreted as limiting, but merely as a basis for the claims and as a representation basis for teaching one skilled in the art to variously employ the present invention in virtually any appropriately detailed structure.

Figure 1:
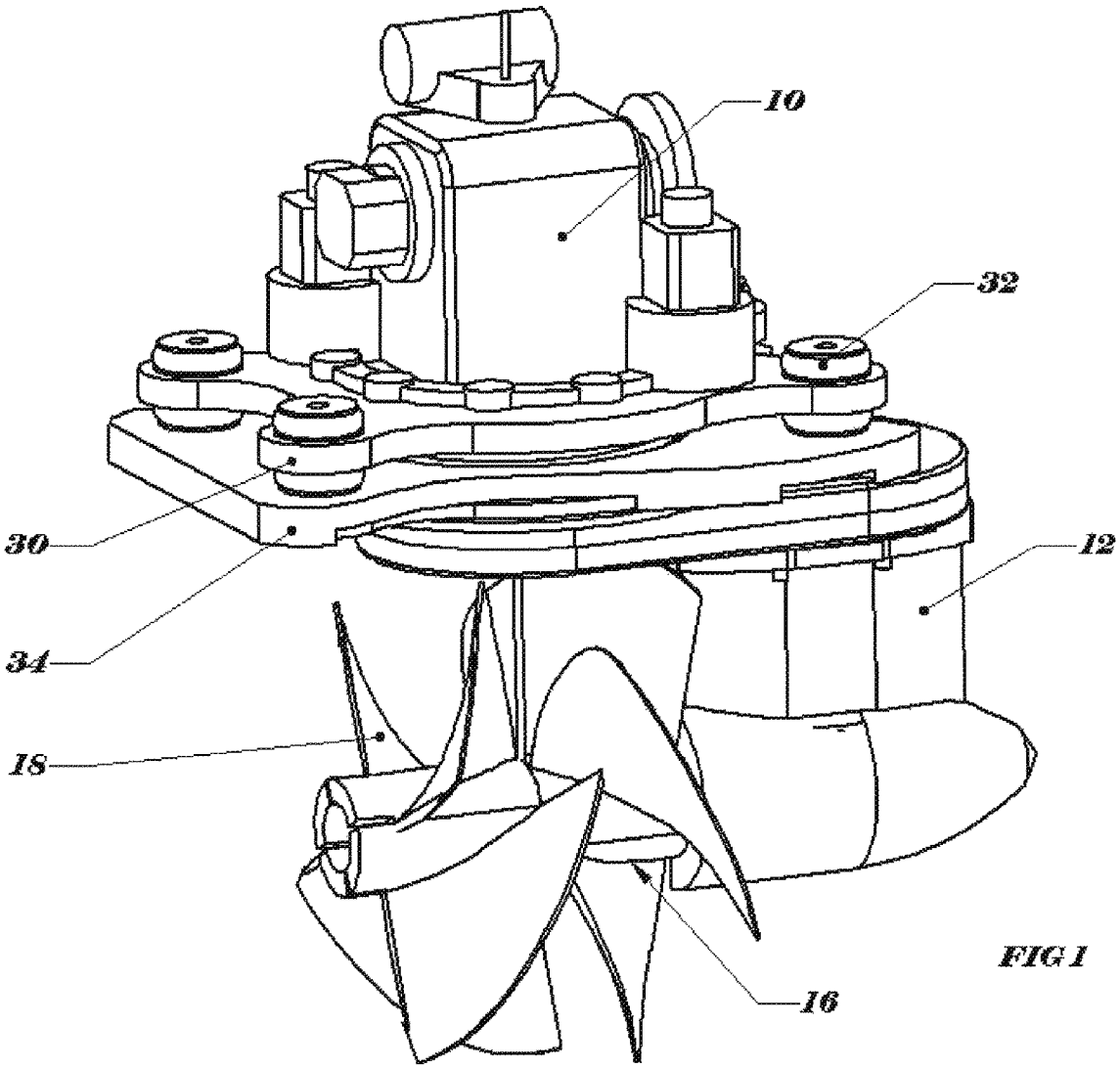
FIG. 1 is a perspective view of the drive system of the instant invention.
Figure 2:
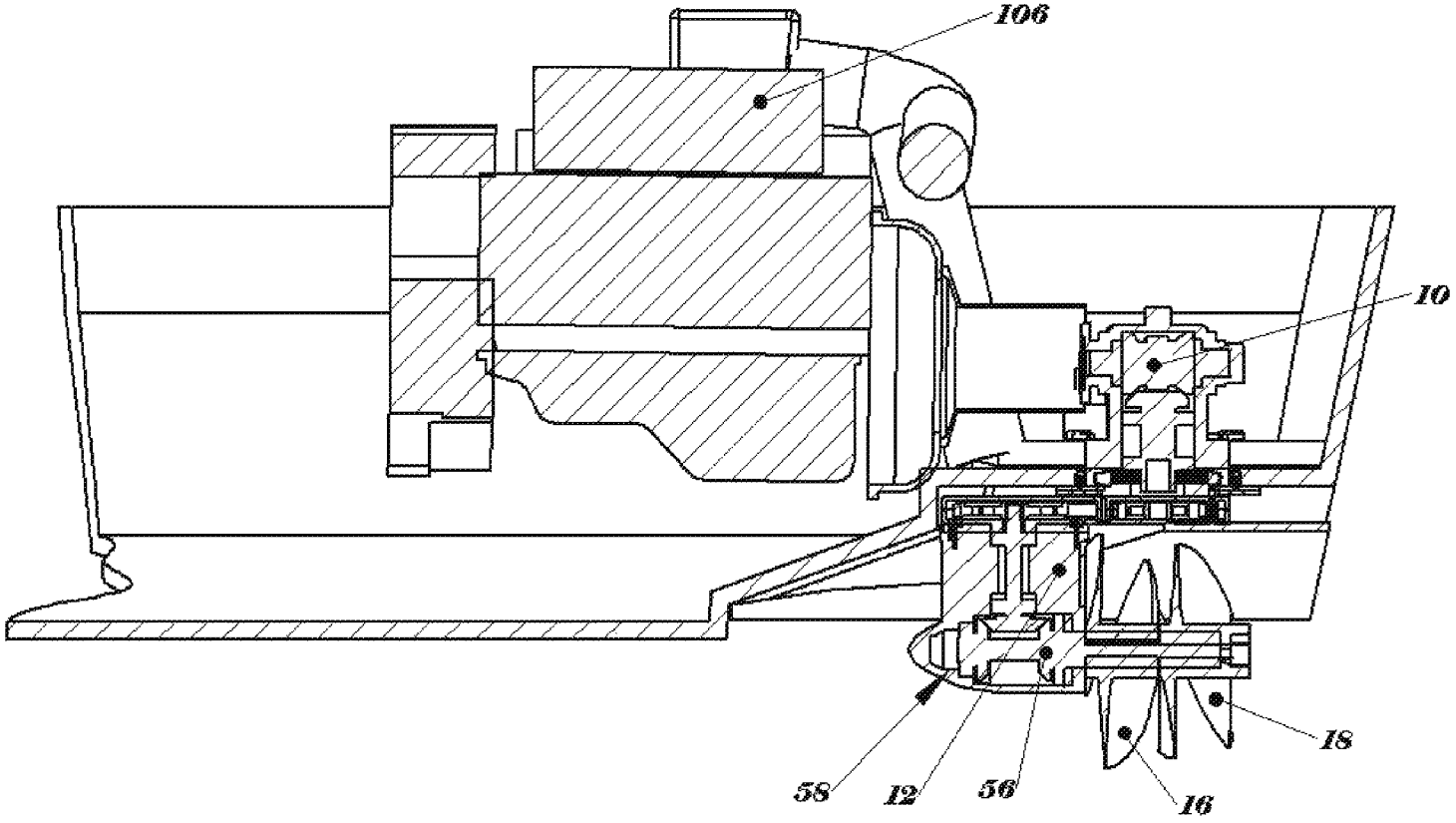
FIG. 2 is a cross-sectional side view of a drive system embodiment having counter-rotating propellers.
Figure 3:
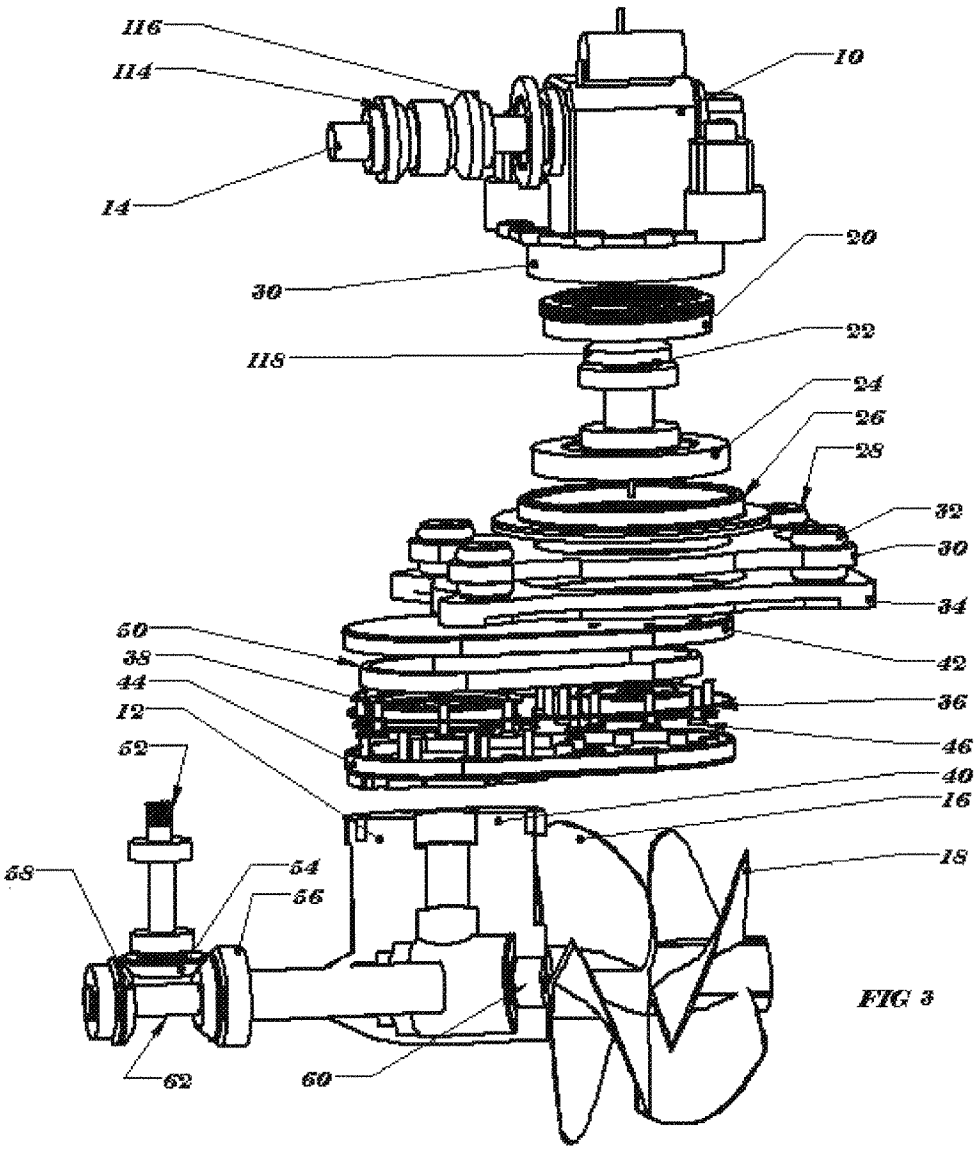
FIG. 3 is an exploded view thereof.

Referring now to FIGS. 1-3, depicted is the marine propulsion system of the instant invention wherein the steering axis of rotation is positioned directly beneath the power transfer gear box, the placement of which allows the propellers to turn within a confined area. The marine propulsion system consists of an upper gear box 10 mounted to an inner surface of a vessel hull 100 forming a first vertical axis centrally disposed in said upper gear box 10. The upper gear box 10 is coupled to a lower gear box 12 rotatably mounted to the outer surface of the vessel hum. As with any conventional drive system, the marine propulsion system converts rotational power received from an internal combustion engine 106 delivered through a transmission for rotation of a clutch gear 14 assembly. Rotation of the clutch gear assembly 14 converts power received from a horizontal drive system through the upper gear case 10. In particular, the assembly employs a upper gear box bevel, gears 114 and 116 for changing direction of shaft rotation by engaging upper drive shaft bevel 118 allowing vertical rotation of the drive shaft through mounting ring 20 which is coupled to drive shaft 22 and main mount retainer 24. A seal 26 encompasses the main mount retainer 24 with a bracket 28 coupled to the base 30 of the upper gear box 10. The base 30 is secured to bracket 42 with vibration addressed using rubber bushings 32 that are mounted to the inner surface of a vessel. The mounting plate 34 allows securement of the upper gear box 10 assembly to a vessel 100 with the lower surface of the base plate 34 attached to the inner surface 102 of the vessel.

The lower gear box 12 is coupled to lower gear box transfer gears 36 and 38, to offset the transfer of power from a directly vertical position to an offset position. Gears 36 and 38 are positioned within upper case 42 and lower case 44 using a plurality of coupling bolts 46, so as to conceal the drive mechanism which, in this embodiment, is a chain belt 50. Alternatively, the gears 36, 38 may be placed next to each other, a chain drive, or a fabric belt may be deployed with the purpose of the gear mechanisms to offset the power drive. It should be noted that the first vertical axis of the upper gear box 10 including the first gear 36 is positioned directly over the propellers 16 and 18. Second gear 38 is provides a second vertical axis offset from said first vertical axis and coupled to spindle 52 using a lower bevel gear 54 for rotation of lower gear box bevel gears 56 and 58, so as to cause rotation of the outer shaft 60 in one direction and inner shaft 62 in an opposite direction. With the propellers 16 and 18 coupled to the shafts 60, 62, the shafts are rotated in opposite directions so as to allow counter rotation of the propellers. Use of counter-rotating propellers nullifies the p-factor caused by single propeller operation. However, it is noted that a single propeller can be used and retain the benefit of the propeller direction for movement to either a port or starboard position.

Figure 4:
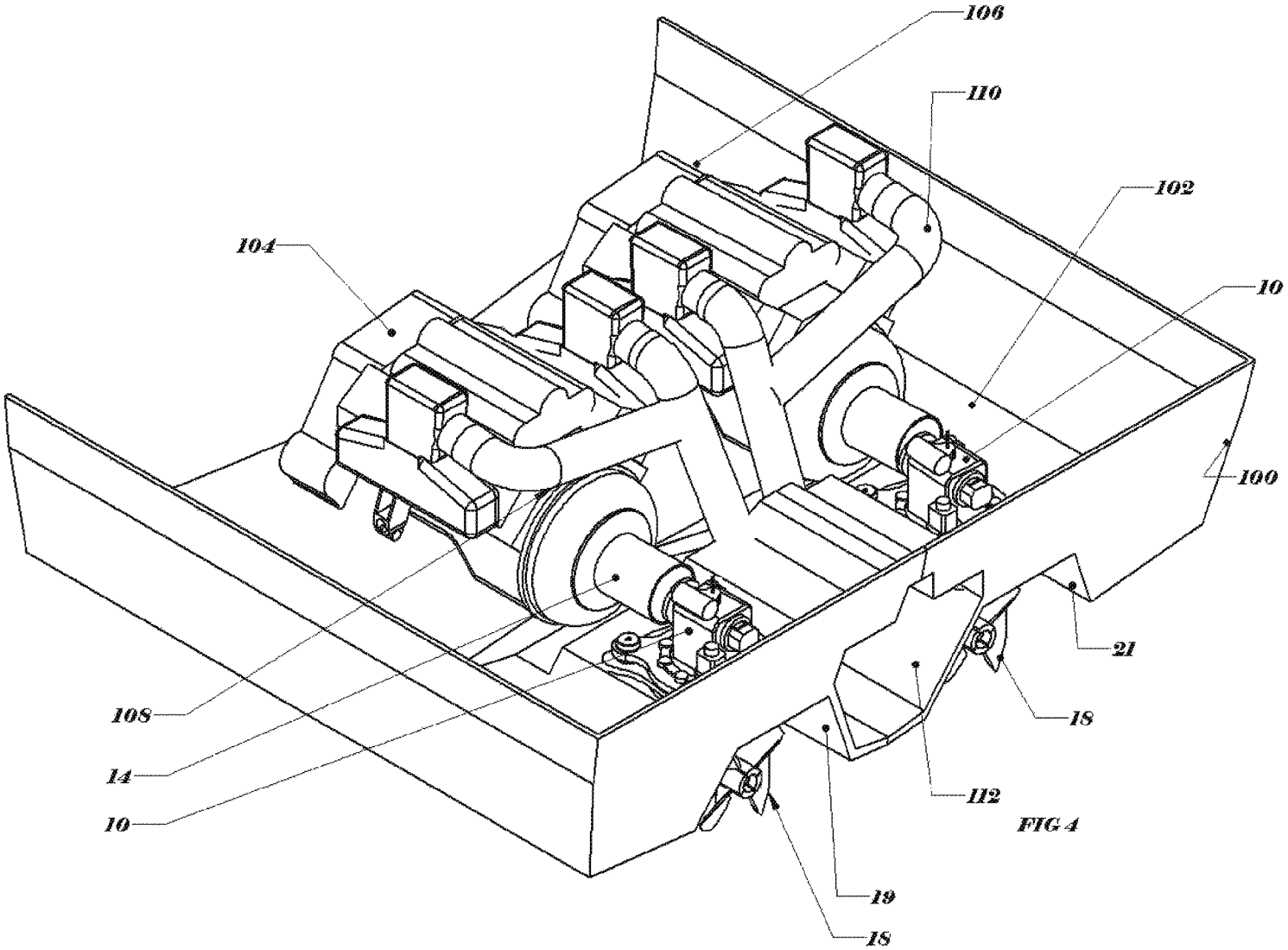
FIG. 4 is a top perspective view of a vessel with two engines and drive systems.

FIG. 4 depicts employment of marine propulsion system in a dual engine vessel having a port engine 104 and a starboard 106 engine. In the preferred embodiment, the internal combustion system each has an exhaust system 108 and 110 which expels unspent gases and cooling water in vent tunnel 112. As depicted, the port propeller 18 is placed within vessel pocket 19 and starboard propeller 18' is placed within vessel pocket 21. As will be described in more detail later in this specification, the marine propulsion system allows the directional placement of the propellers to be rotated within a very small diameter. The engine 104 causes rotation of the clutch gear assembly 14 delivering a rotational power input into the upper gear box 10. The upper gear boxes 10 can be positioned directly behind an engine as depicted, or at a distance from an engine by use of an extended drive shaft. The compact size of the upper gear box 10 allows the vessel designer great flexibility in positioning the engine and marine propulsion system so as to allow for optimum weight distribution and steering efficiency.

Figure 5:
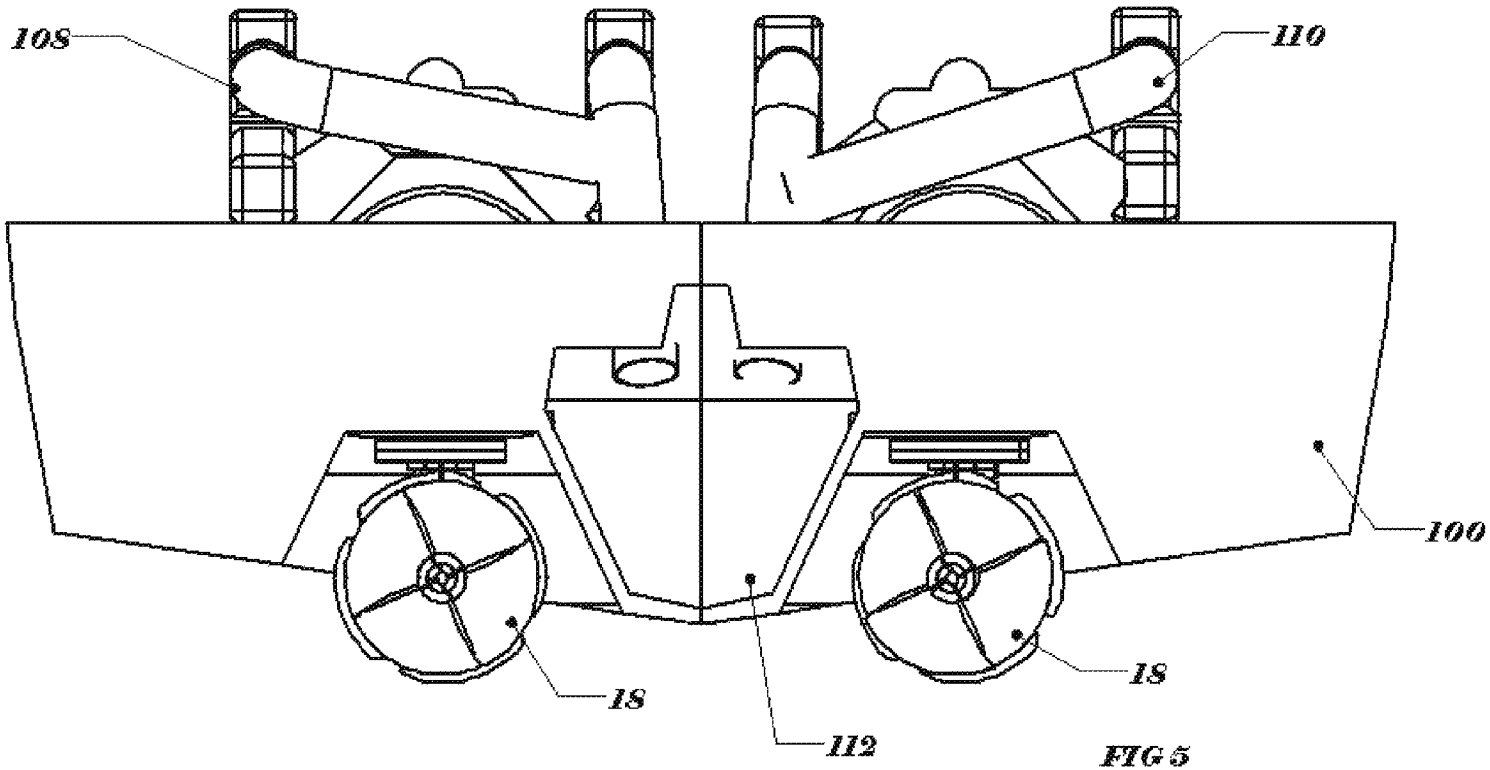
FIG. 5 is a review view of FIG. 4.
Figure 6:
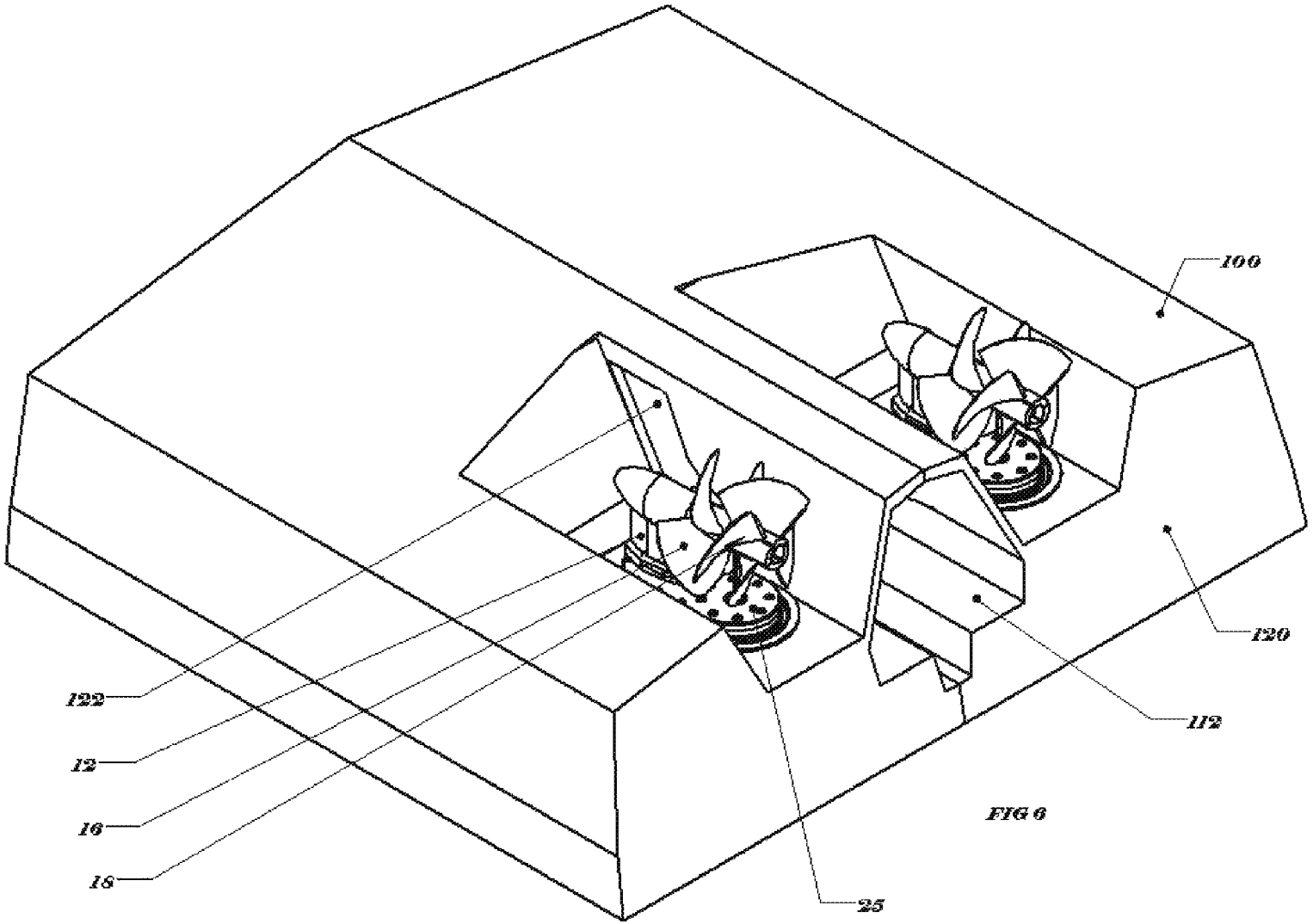
FIG. 6 is a bottom perspective view of FIG. 4.

FIG. 5 depicts the rear of the vessel 100 and the position of the propellers 18 and 18' placed on either side of the vent tunnel 112 and well within a vessel hull pockets. The vent tunnel being of a design by the inventor capable of drawing air from the rear 120 of the vessel 100, to a discharge port 122 located before the propellers. This technology allows surface piercing propellers to be placed beneath a vessel wherein air is drawn through the vent 112 to the port 122 thereby introducing air before the propeller assembly, providing all of the advantages of a surface piercing propeller regarding efficiency, and without the drawback of having the surface piercing propeller extend outward from the rear of the vessel, known to present a safety issue with conventional surface piercing propellers. FIG. 6 further illustrates the positioning of the lower gear box in relation to the propeller 16 and 18 positioning, the axle of rotation 25 being directly above the propellers 16 and 18.

Figure 7:
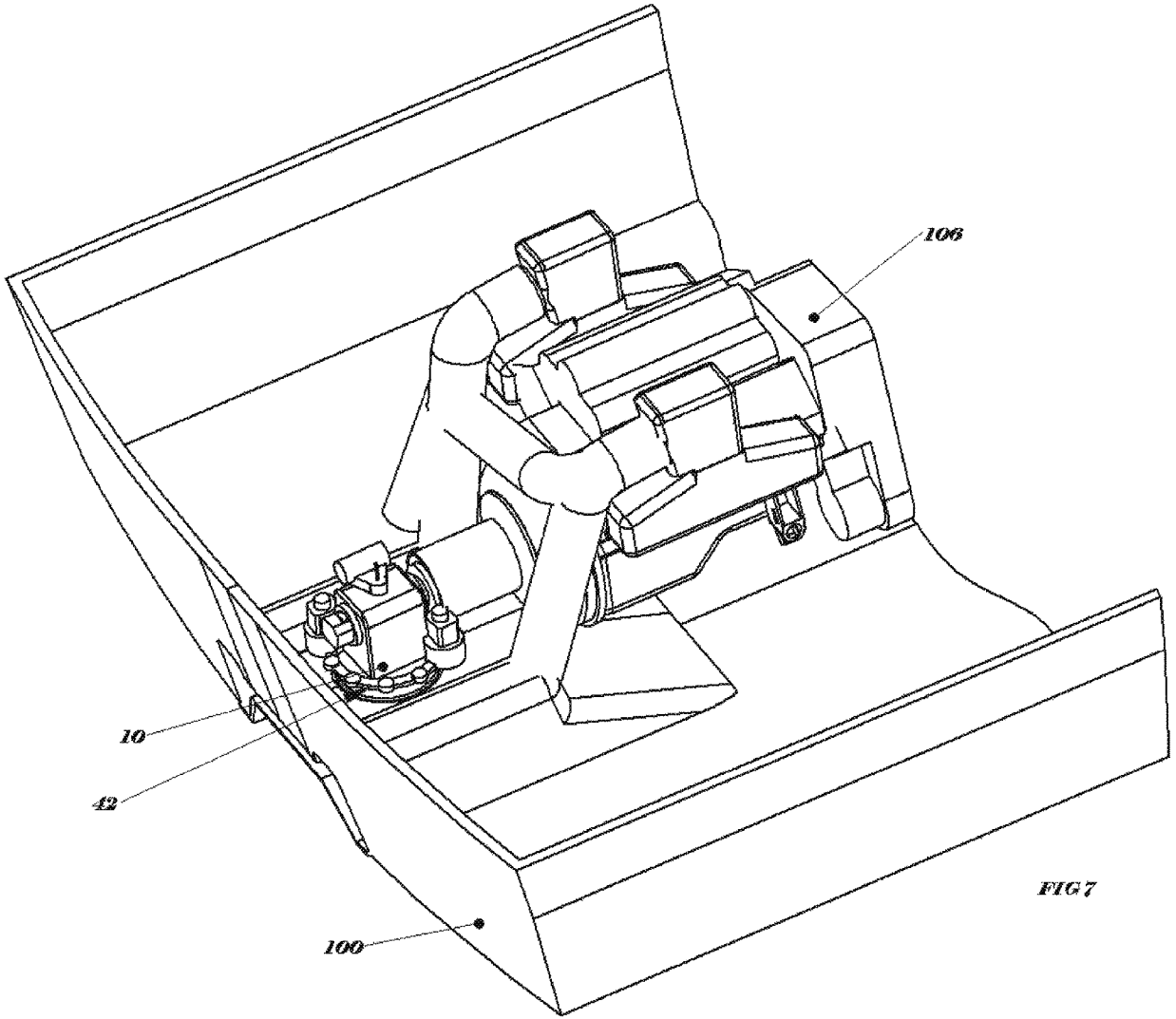
FIG. 7 is a top perspective view of a vessel with one engine and drive system.
Figure 8:
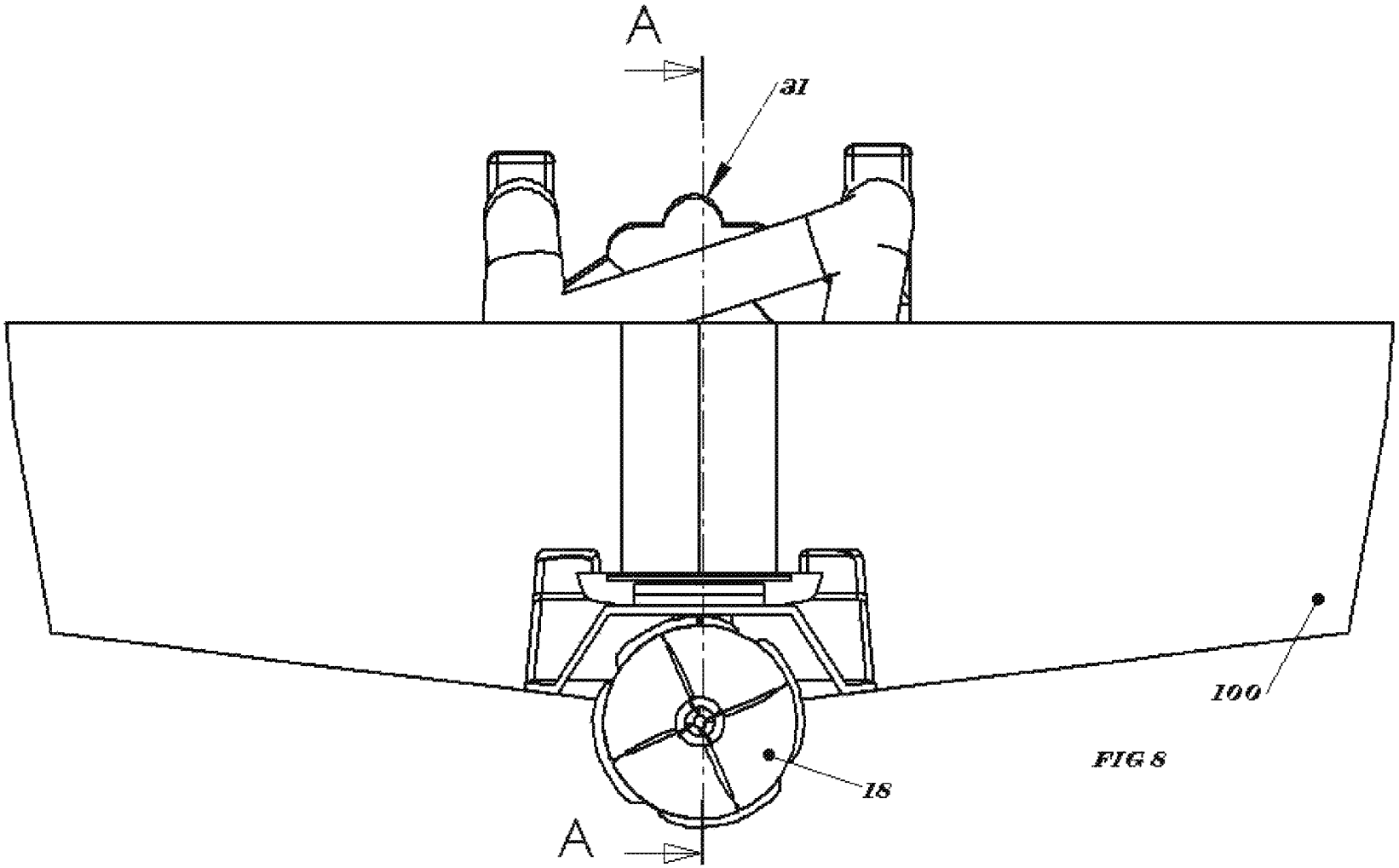
FIG. 8 is a rear view of FIG. 7.

FIG. 7 depicts a single internal combustion engine 106 within a vessel 100, wherein the gear box 10 can be seen mounted above gear box cover 42. FIG. 8 depicts the rear of the vessel 100 with propeller 18 depicted along the center line 31 of the vessel, and as previously mentioned, the use of counter-rotating propellers prevents low speed propeller walk.

Figure 9:
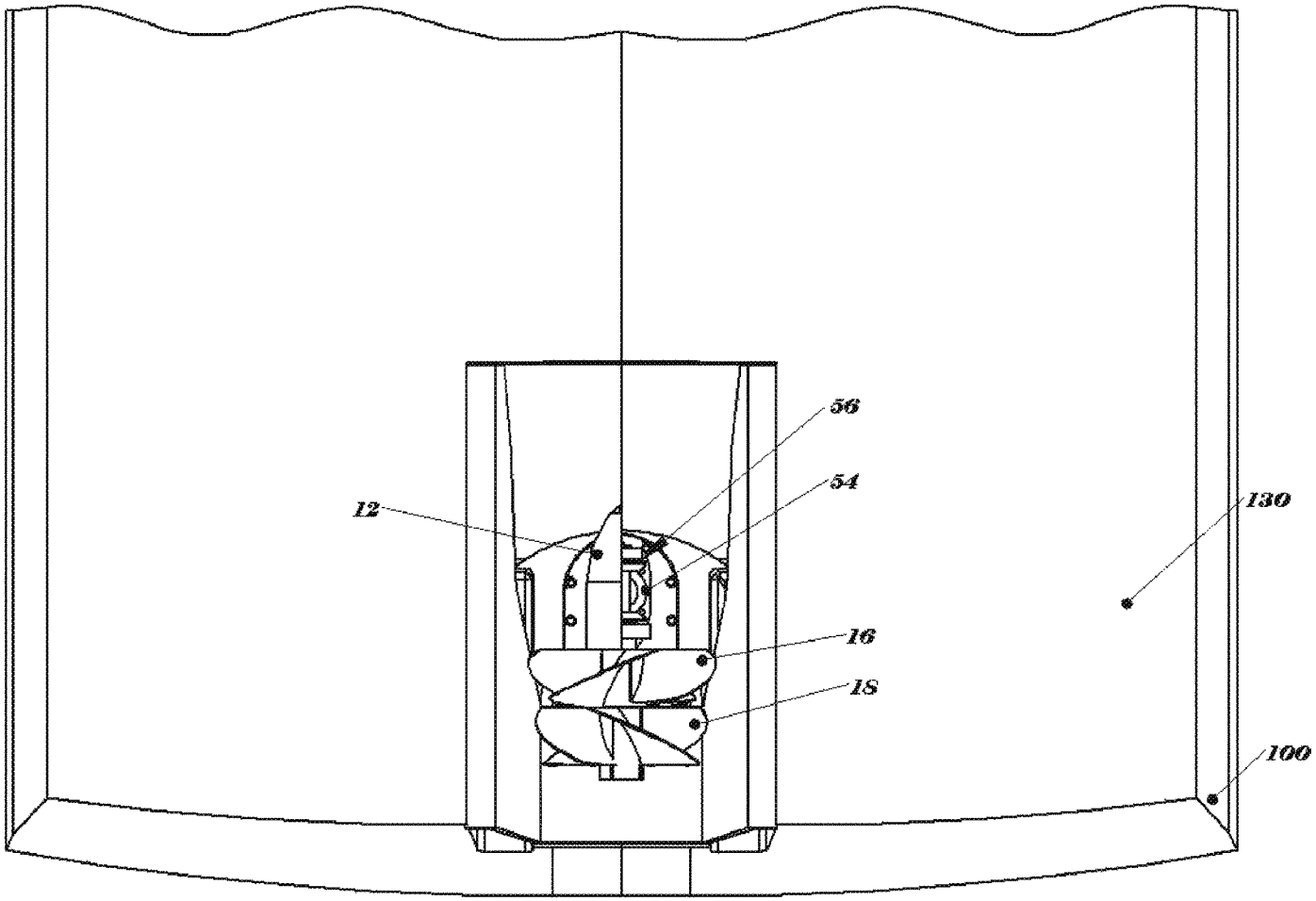
FIG. 9 is a bottom view of FIG. 7 depicting the drive system in axial alignment.

The bottom of the vessel 100, depicted in FIG. 9, illustrates the lower gear box 12 with a partial cutaway to illustrate lower gear box bevel gear 56 and 58, rotated by vertical bevel 54, causing a change from a vertical directional rotation of the offset drive shaft to a horizontal position for independent rotation of said first and second propellers 16 and 18, respectively.

Figure 10:
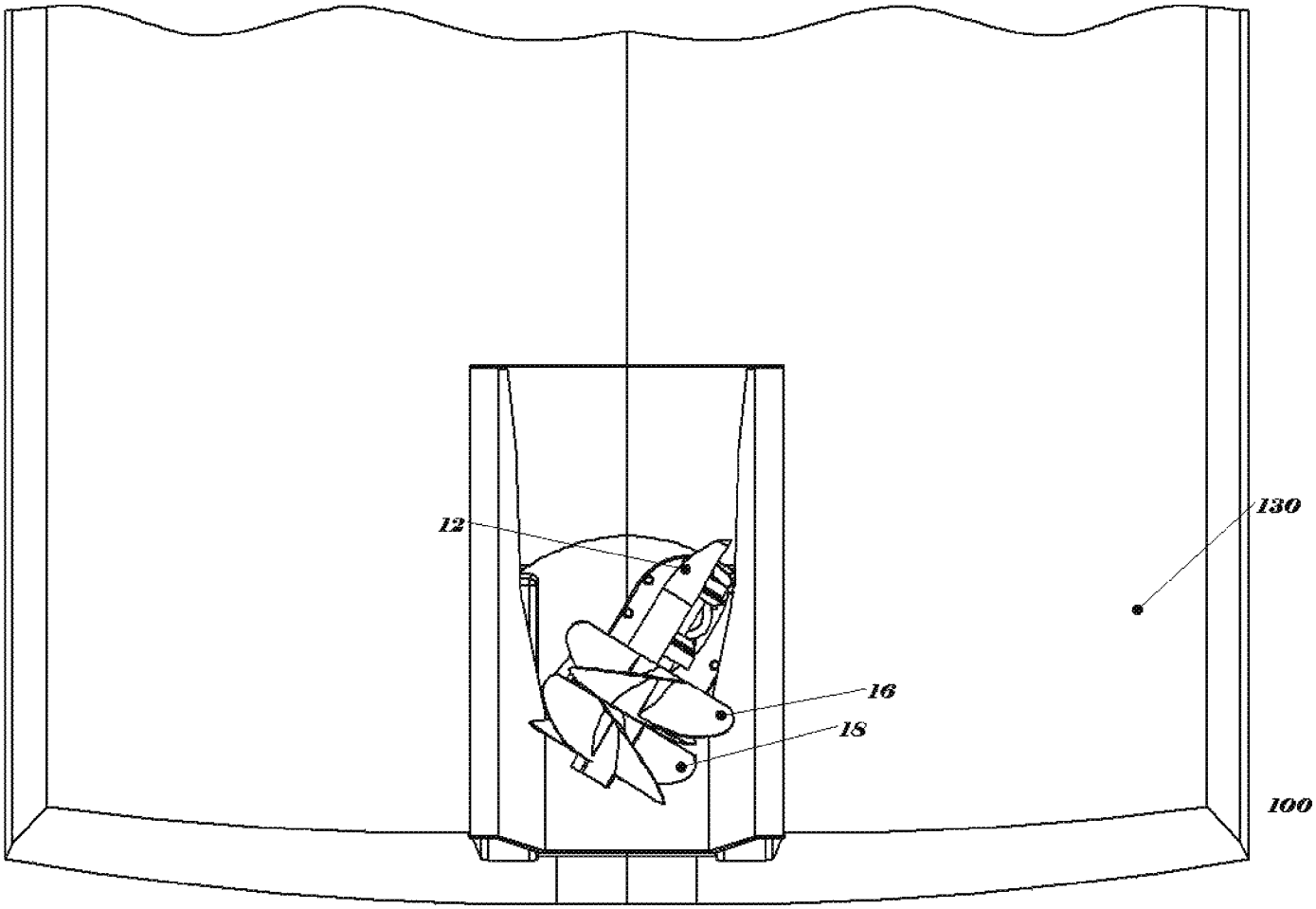
FIG. 10 is a bottom view of FIG. 7 depicting the drive system turned to port.
Figure 11:
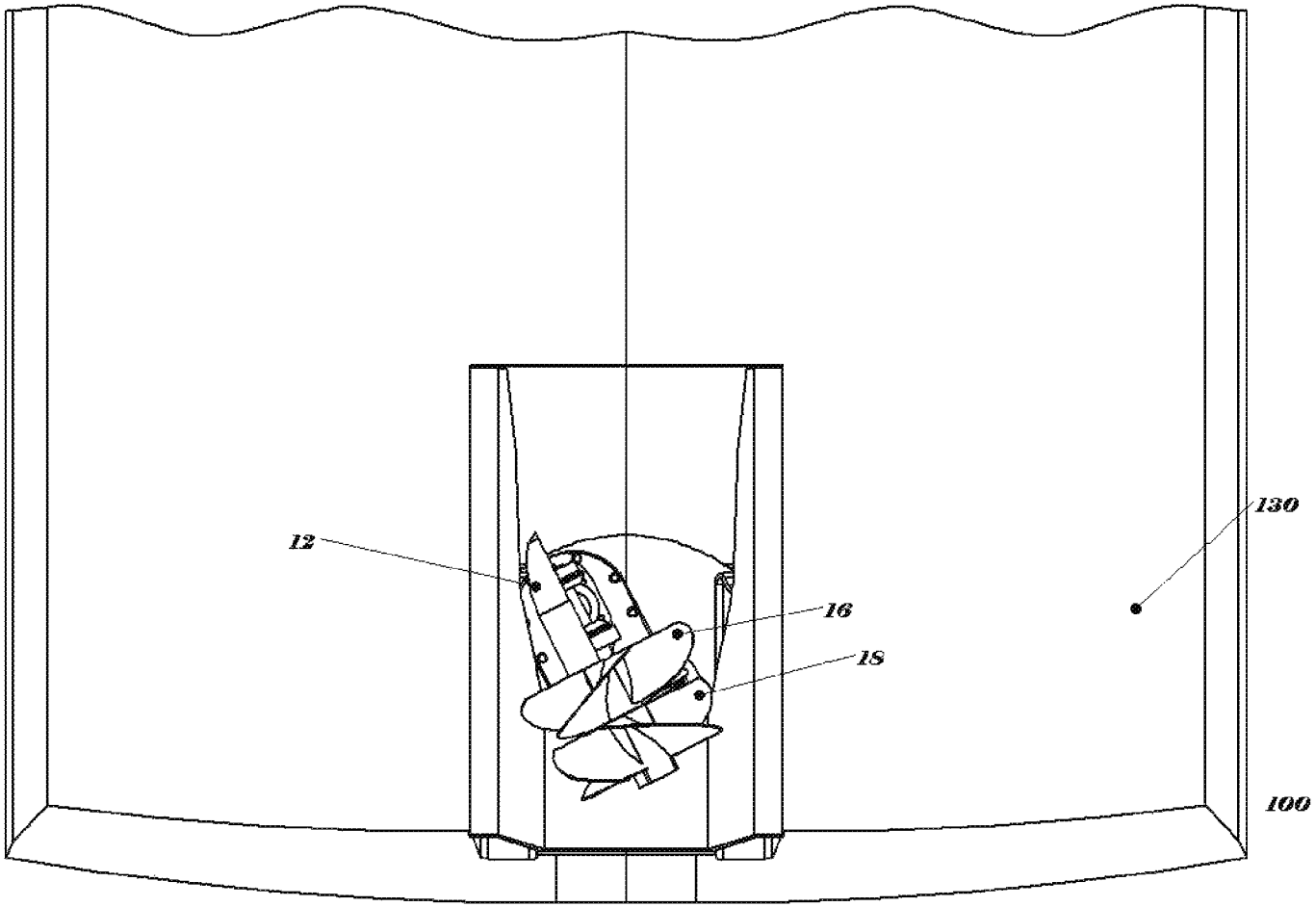
FIG. 11 is a bottom view of FIG. 7 depicting the drive system turned to starboard.

FIG. 10 depicts the lower gear box 12 in rotation with propellers 16 and 18, so as to cause movement of the vessel to port by rotation of the gear box and propellers. Similarly, in FIG. 11, gear box 12 is shown rotating propellers 16 and 18 to a starboard direction, allowing low speed maneuverability of the vessel without the need for an additional rudder.

Figure 12:
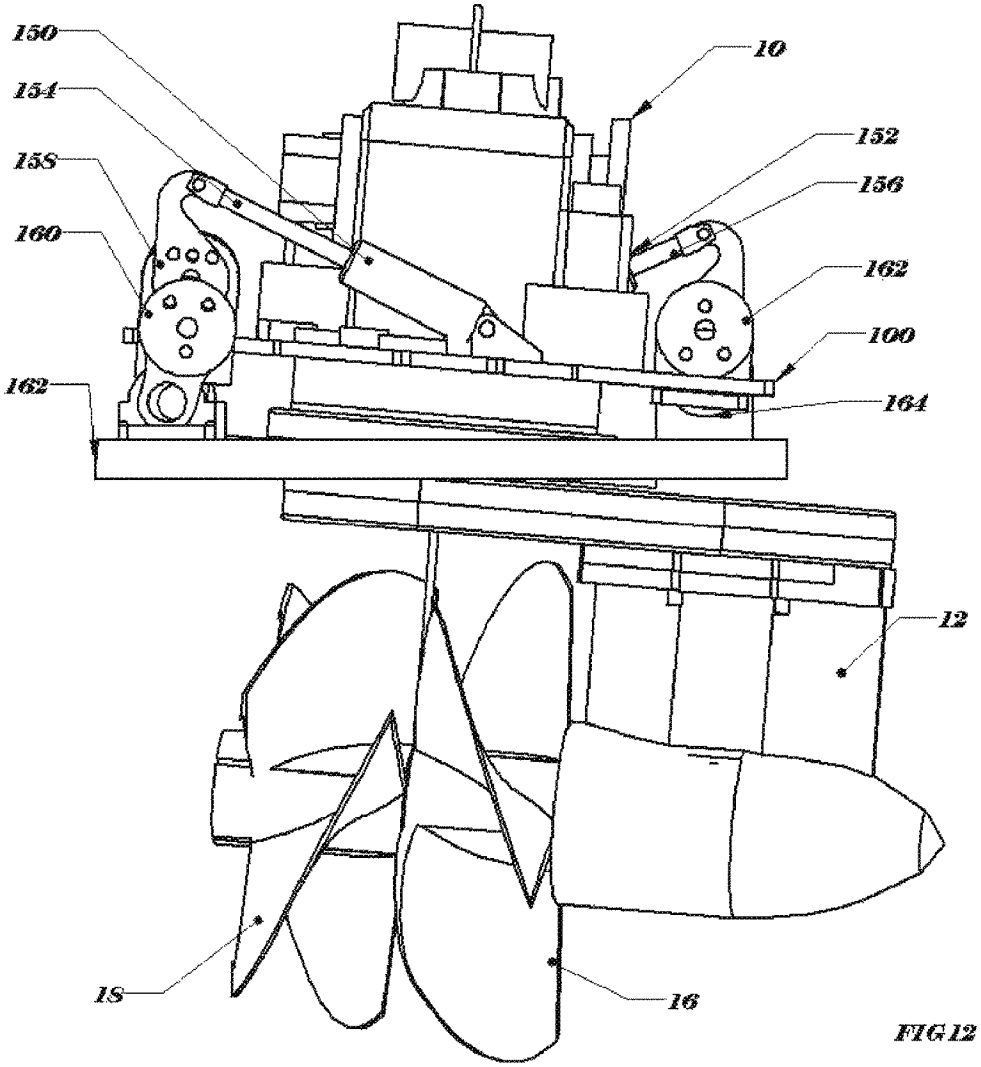
FIG. 12 is a side view depicting a tilt option for the drive system.

Referring now to FIG. 12, shown is an embodiment of the marine propulsion system having the gear box 10 securely fastened to the inside of a vessel hull 100, wherein pistons 150 and 152 can be used to tilt the lower gear box 12. In this embodiment, rear piston 150 operates in conjunction with forward piston 152. As rear piston 150 is expanded, a pivot drive 158 displaces pivot base 160 causing the rear of the lower gear box 12 to be tilted downward. Similarly, front piston 152 can be retracted wherein drive rod 152 rotates forward pivot drive 162 to reduce in size to the base pivot drive 164 lifting the front of the gear box 12. The operation of the forward piston 152 and rear piston 150 allows the gear box 12 to change in orientation so as to cause tilting of the propellers axial of alignment allowing the vessel operator to effectively trim the vessel. Trimming of the vessel allows the operator to raise or lower the bow of the boat while at a particular speed to accommodate for wave heights, loading of the boat, or any other reason to make the boat operate efficiently on the water.

In a preferred embodiment, the vented tunnel would be in accordance with either U.S. Pat. Nos. 6,193,753; 6,045,420; 6,213,824; or 6,325,010. In this configuration, the propellers can be either surfacing or submerged types. However, in the preferred embodiment, the propellers would be counter-rotating as they are efficient and eliminate unidirectional propeller torque. A benefit of the drive system is that it not only includes the ability for forward propulsion, but provides for steering of the vessel by allowing for rotation of the lower gear case. In this embodiment, the propellers are able to swivel around their own envelope, as opposed to other outdrives, which swing propellers to an arch pivoting around a vertical axis, but not directed to the center of the propellers. This further allows for a smaller through-hull opening to be made in the vessel; but most importantly, provides a compact drive system that can effectively turn within its own radius by positioning of the swivel for the steering axis directly over or near the propellers. By allowing the lower gear case and propellers to swivel within a confined area, the marine propulsion device is especially suited for placement within tunnels beneath the vessel or the boat, wherein the width of the tunnel may not be expanded, and the need for an additional rudder can be reduced or eliminated. Placement of the marine propulsion unit within a tunnel, whether vented or unvented, allows for use of the vessel in areas where minimal draft is preferred. In a preferred embodiment, the propellers may be placed completely within the tunnel, essentially providing a zero draft vessel. The instant invention allows for a reduced hull seal and mounting mechanism, wherein only the lower gear case is positioned outside the hull. As minimum torque is required for rotation of the propellers around a steering axis positioned directly over the propellers, the size of the through-hull can be substantially reduced, thereby increasing the overall integrity of the hull by minimal material displacement.

Development of a counter-rotating surface drive system for placement under a boat hull is the ultimate configuration for marine drive technology. The current invention solves problems under hull drives and, when use with surfacing propellers, the space savings allow for venting air into a tunnel in accordance with the Applicant's prior art patents, and allows for counter-rotating surfacing propellers to be with the additional benefit of a shallow draft vessel having the efficiency of the surface piecing propeller.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims.

What is claimed is:

1. A marine propulsion system comprising:

an upper gear box mounted to an inner surface of a boat hull having a centrally disposed drive shaft along a first vertical axis;

a lower gear box rotatably mounted to an outer surface of the boat hull;

a first transfer gear located within said lower gear box and coupled to said drive shaft;

a second transfer gear located within said lower gear box and rotatably coupled to said first transfer gear, said second transfer gear forming a second vertical axis offset from said first vertical axis;

a vertical spindle rotatable attached to said second transfer gear;

at least one horizontal shaft having a first end rotatably attached to said vertical spindle and a second end attached to a propeller;

wherein said propeller is positioned beneath said first vertical axis allowing for a steering pivot point located directly beneath said lower gear case.

2. The marine propulsion system according to claim 1 wherein said horizontal shaft includes two opposing bevel gears each rotated by said vertical spindle, said bevel gears each coupled to a coaxial shaft each attached to a propeller, said opposing bevel gears allowing one coaxial shaft to rotate a first propeller in one direction and counter rotate a second propeller.

3. The marine propulsion system according to claim 1 wherein said propeller positioned within a vented tunnel.

4. The marine propulsion system according to claim 3 wherein said propeller is a surface piercing propeller.

5. The marine propulsion system according to claim 1 wherein said lower gear box is tilted allowing the boat to be trimmed for optimum operational efficiency.

6. The marine propulsion system according to claim 5 wherein said gear box is tilted by use of a piston located along a front and a rear of the lower gear box, said pistons causing said lower gear box to change in orientation.

7. The marine propulsion system according to claim 6 wherein including a pivot drive coupled to each said piston, said pivot drive displaces a pivot base to allow tilting of said lower gear box.

* * * * *